US012677962B2

(12) United States Patent
Zhang et al.

(10) Patent No.: US 12,677,962 B2
(45) Date of Patent: Jul. 14, 2026

(54) FOLDING BED STRUCTURE

(71) Applicant: ANHUI COOLBABY SCIENCE & TECHNOLOGY DEVELOPMENT CORPORATION., Lu'an (CN)

(72) Inventors: Lei Zhang, Lu'an (CN); Zehua Yi, Lu'an (CN)

(73) Assignee: ANHUI COOLBABY SCIENCE & TECHNOLOGY DEVELOPMENT CORPORATION., Lu'an (CN)

( * ) Notice: Subject to any disclaimer, the term of this patent is extended or adjusted under 35 U.S.C. 154(b) by 0 days.

(21) Appl. No.: 18/878,126

(22) PCT Filed: Oct. 31, 2023

(86) PCT No.: PCT/CN2023/128017

§ 371 (c)(1),
(2) Date: Dec. 23, 2024

(87) PCT Pub. No.: WO2024/152662

PCT Pub. Date: Jul. 25, 2024

(65) Prior Publication Data

US 2025/0351975 A1 Nov. 20, 2025

(30) Foreign Application Priority Data

Jan. 18, 2023 (CN) ..... 202320130629.2

(51) Int. Cl.
*A47D 9/00* (2006.01)

(52) U.S. Cl.
CPC ..... *A47D 9/005* (2013.01)

(58) Field of Classification Search
CPC ..... A47D 9/005; A47D 13/063; A47D 7/00
See application file for complete search history.

(56) References Cited

U.S. PATENT DOCUMENTS 11,864,667 B1 * 1/2024 Zhang ..... A47D 9/005
12,035,820 B1 * 7/2024 Zhang ..... A47D 13/063
(Continued)

FOREIGN PATENT DOCUMENTS

CN 114052439 A 2/2022
CN 115316816 A * 11/2022 ..... A47D 9/005
(Continued)

*Primary Examiner* — Aaron R Eastman
(74) *Attorney, Agent, or Firm* — Bayramoglu Law Offices LLC

(57) ABSTRACT

A folding bed structure includes: a joint connector, where the joint connector is symmetrically provided with two first sliding grooves near an upper part of the joint connector, a distance between the two first sliding grooves gradually increases from top to bottom, and a second sliding groove is provided on each of sides, facing away from each other, of the two first sliding grooves; two upper enclosing rods, where the two upper enclosing rods are located on both sides of the joint connector respectively, a first guide pin is provided at each of ends, adjacent to each other, of the two upper enclosing rods, the first guide pin is embedded in the first sliding groove and can slide along the first sliding groove, and a rod body part of the upper enclosing rod is slidably connected to the joint connector; and two lower enclosing rods.

5 Claims, 4 Drawing Sheets

(56) References Cited

U.S. PATENT DOCUMENTS

| | | | | |
|---|---|---|---|---|
| 2003/0061657 | A1* | 4/2003 | Longenecker | A47D 13/063 5/99.1 |
| 2006/0021137 | A1* | 2/2006 | Waldman | A47D 13/063 5/99.1 |
| 2006/0021138 | A1* | 2/2006 | Waldman | A47D 13/063 5/99.1 |
| 2009/0172879 | A1* | 7/2009 | Hsu | A47D 13/063 5/99.1 |
| 2010/0218311 | A1* | 9/2010 | Rivera | A47D 13/063 5/99.1 |
| 2018/0008056 | A1* | 1/2018 | Yang | F16B 7/14 |
| 2018/0168365 | A1* | 6/2018 | Huang | A47D 7/002 |
| 2018/0332977 | A1* | 11/2018 | Sozzo | A47D 9/005 |
| 2022/0296007 | A1* | 9/2022 | Mao | A47D 13/063 |

FOREIGN PATENT DOCUMENTS

| | | | | | |
|---|---|---|---|---|---|
| CN | 218390478 | | * | 1/2023 | A47D 13/063 |
| CN | 218390478 | U | * | 1/2023 | A47D 13/063 |
| CN | 218390487 | U | * | 1/2023 | A47D 13/063 |
| CN | 115813152 | A | * | 3/2023 | A47D 9/005 |
| CN | 219088810 | U | | 5/2023 | |
| CN | 219088811 | U | | 5/2023 | |
| CN | 116268872 | A | | 6/2023 | |
| CN | 219479669 | U | | 8/2023 | |
| CN | 219479671 | U | | 8/2023 | |
| CN | 220423594 | U | * | 2/2024 | A47C 19/126 |
| WO | 2016058505 | A1 | | 4/2016 | |

* cited by examiner

FOLDING BED STRUCTURE

CROSS-REFERENCE TO THE RELATED APPLICATIONS

This application is the national phase entry of International Application No. PCT/CN2023/128017, filed on Oct. 31, 2023, which is based upon and claims priority to Chinese Patent Application No. 202320130629.2, filed on Jan. 18, 2023, the entire contents of which are incorporated herein by reference.

TECHNICAL FIELD

The present disclosure relates to the field of folding bed design and in particular to a folding bed structure.

BACKGROUND

Existing cribs are mainly used to confine babies inside, thereby providing a safe play space and sleeping space. It is extremely inconvenient to disassemble the skeleton of a crib after use, and a screwdriver is needed to remove the bolts at the skeleton joints. Moreover, the removed bolts and skeleton joints are easily lost during storage, which affects the subsequent normal installation and use of crib.

To solve this problem, it is possible to fold and store the unused crib. However, when the existing storable crib is folded, it is very hard to realize the angular transformations between various components, such that a lot of effort is required to compress the bed body, and the parts where the rods are connected are easily broken or worn.

SUMMARY

According to the various embodiments of the present disclosure, a folding bed structure is provided.

A folding bed structure includes a plurality of mounting sleeves, and an armrest assembly arranged between adjacent mounting sleeves. The armrest assembly includes:

a joint connector, where the joint connector is symmetrically provided with two first sliding grooves near an upper part of the joint connector, and a distance between the two first sliding grooves gradually increases from top to bottom; and a second sliding groove is provided on each of sides, facing away from each other, of the two first sliding grooves;

two upper enclosing rods, where the two upper enclosing rods are located on both sides of the joint connector respectively, a first guide pin is provided at each of ends, adjacent to each other, of the two upper enclosing rods, and the first guide pin is embedded in the first sliding groove and can slide along the first sliding groove; a rod body part of the upper enclosing rod is slidably connected to the joint connector, a second guide pin is arranged on the rod body of the upper enclosing rod, and the second guide pin is slidably embedded in the second sliding groove; and ends, away from each other, of the upper enclosing rods are rotatably connected to the mounting sleeves;

when the folding bed structure is unfolded, the first guide pin is positioned on the top of the first sliding groove, and the second guide pin is positioned on an end, adjacent to the first sliding groove, of the second sliding groove; and when the folding bed structure is folded, the first guide pin slides to the bottom of the first sliding groove, and the second guide pin slides towards an end away from the first sliding groove;

two lower enclosing rods, where the two lower enclosing rods are respectively arranged under one upper enclosing rod side by side; and ends, away from each other, of the lower enclosing rods are respectively rotatably connected to the mounting sleeves, and ends, adjacent to each other, of the lower enclosing rods are respectively slidably connected to the joint connector; and a lower part of each of the mounting sleeves is connected to a support seat through an upright rod, and each support seat is hinged to an unlocking base arranged in the middle of a lower part of a bed body through a connection rod group.

In one embodiment, third sliding grooves extending up and down are symmetrically formed in a lower part of the joint connector, and a third guide pin is formed at each of the ends, adjacent to each other, of the two lower enclosing rods; and the third guide pin is embedded in the third sliding groove and can slide along the third sliding groove; and when the folding bed structure is unfolded, the third guide pin is positioned at the bottom of the third sliding groove, and when the folding bed structure is folded, the third guide pin slides towards the top of the third sliding groove.

In one embodiment, a length of the third sliding groove is 3-5 mm.

In one embodiment, an included angle between the first sliding groove and a horizontal plane is 45°-60°.

In one embodiment, a length of the first sliding groove is 3-5 mm.

In one embodiment, the second sliding groove extends horizontally.

In one embodiment, the unlocking base includes an upper unlocking base and a lower unlocking base that are inserted up and down;

the connection rod group includes an upper connection rod and a lower connection rod group that are arranged side by side up and down; both ends of the upper connection rod are respectively hinged to a side of the upper unlocking base and the support seat; and the lower connection rod group includes a first lower connection rod and a second lower connection rod that are hinged; and an outer end of the first lower connection rod is hinged to the support seat, and an inner end of the second lower connection rod is hinged to the lower unlocking base.

The details of one or more embodiments of the present disclosure are set forth in the figures and description below. Other features, objects, and advantages of the present disclosure are reflected by the specification, drawings, and claims.

BRIEF DESCRIPTION OF THE DRAWINGS

To better describe and illustrate embodiments and/or examples provided by the present disclosure, one or more of the figures can be used for reference. The additional details or examples used to describe the figures should not be considered as limitations on the scope of any of the present disclosure, the presently described embodiments and/or examples, and the presently understood best mode of these disclosures.

In the figures,

10. mounting sleeve;

20. joint connector; 21. first sliding groove; 22. second sliding groove; 23. third sliding groove;

30. upper enclosing rod; 31. first guide pin; 32. second guide pin;

40. lower enclosing rod; 41. third guide pin;

50. upright rod;

60. support seat;

70. connection rod group; 71. upper connection rod; 72. first lower connection rod; 73. second lower connection rod;

80. unlocking base; 81. upper unlocking base; 82. lower unlocking base.

DETAILED DESCRIPTION OF THE EMBODIMENTS

The present disclosure is further explained below in conjunction with the figures.

In order to facilitate the understanding of the present disclosure, the present disclosure will be described more fully below with reference to relevant drawings. Preferable embodiments of the present disclosure are shown in the figures. However, the present disclosure can be implemented in many different forms and is not limited to the embodiments described herein. Those skilled in the art will recognize that changes and improvements can be made to the various embodiments described herein without departing from the scope of the present disclosure as defined by the appended claims. In addition, descriptions of well-known functions and constructions may be omitted for clarity and brevity.

It should be understood that when an element is referred to as being "fixed" to another element, it can be directly on another element or there can also be an intermediate element; when an element is referred to as being "connected" to another element, it can be directly connected to another element or there can be an intermediate element at the same time.

Unless otherwise defined, all technical and scientific terms used herein have the same meaning as commonly understood by those skilled in the technical field of the present disclosure. The terms used herein in the specification of the present disclosure are for the purpose of describing the specific embodiments only and are not intended to limit the present disclosure. The terms "and/or" as used herein includes any and all combinations of one or more of the associated listed items.

Figure 1:
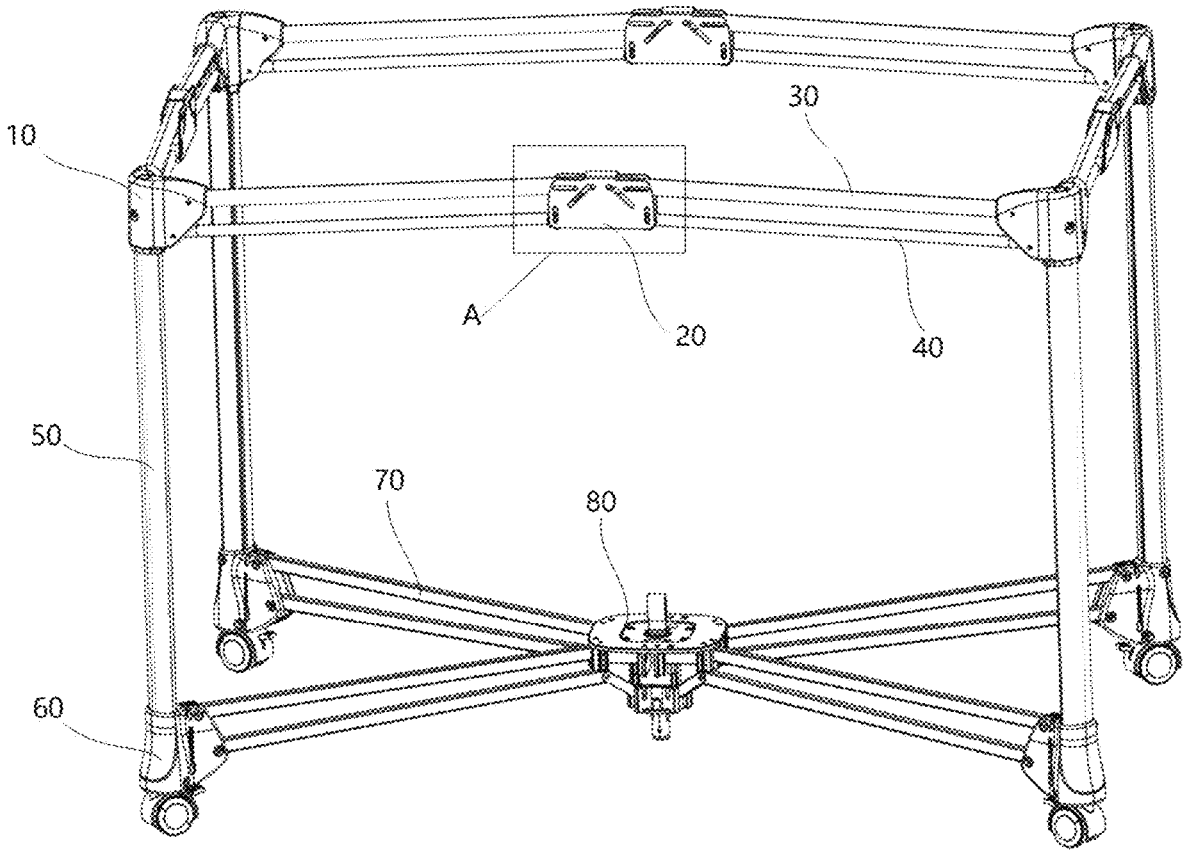
FIG. 1 is a schematic diagram of the folding bed structure in an unfolded state according to an embodiment.
Figure 2:
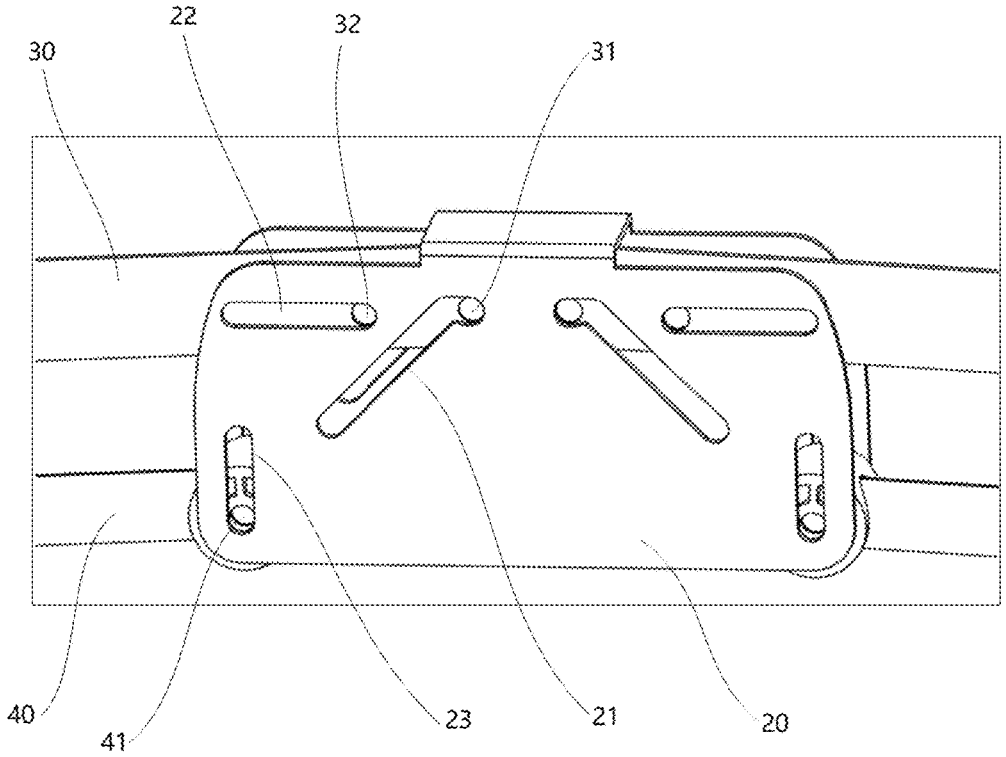
FIG. 2 is an enlarged view of part A in FIG. 1.
Figure 3:
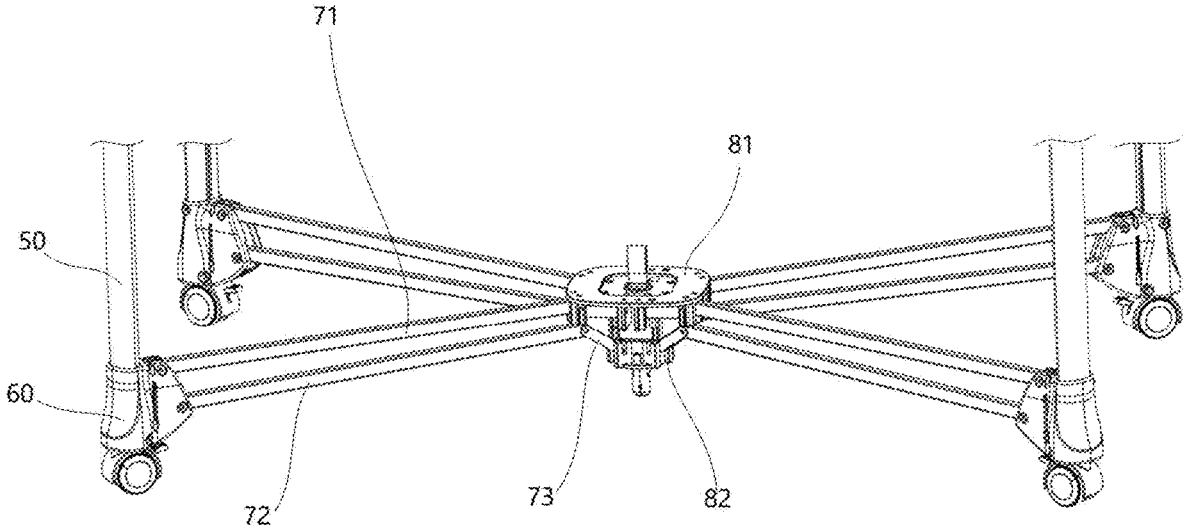
FIG. 3 is an enlarged view of the bottom in FIG. 1.
Figure 4:
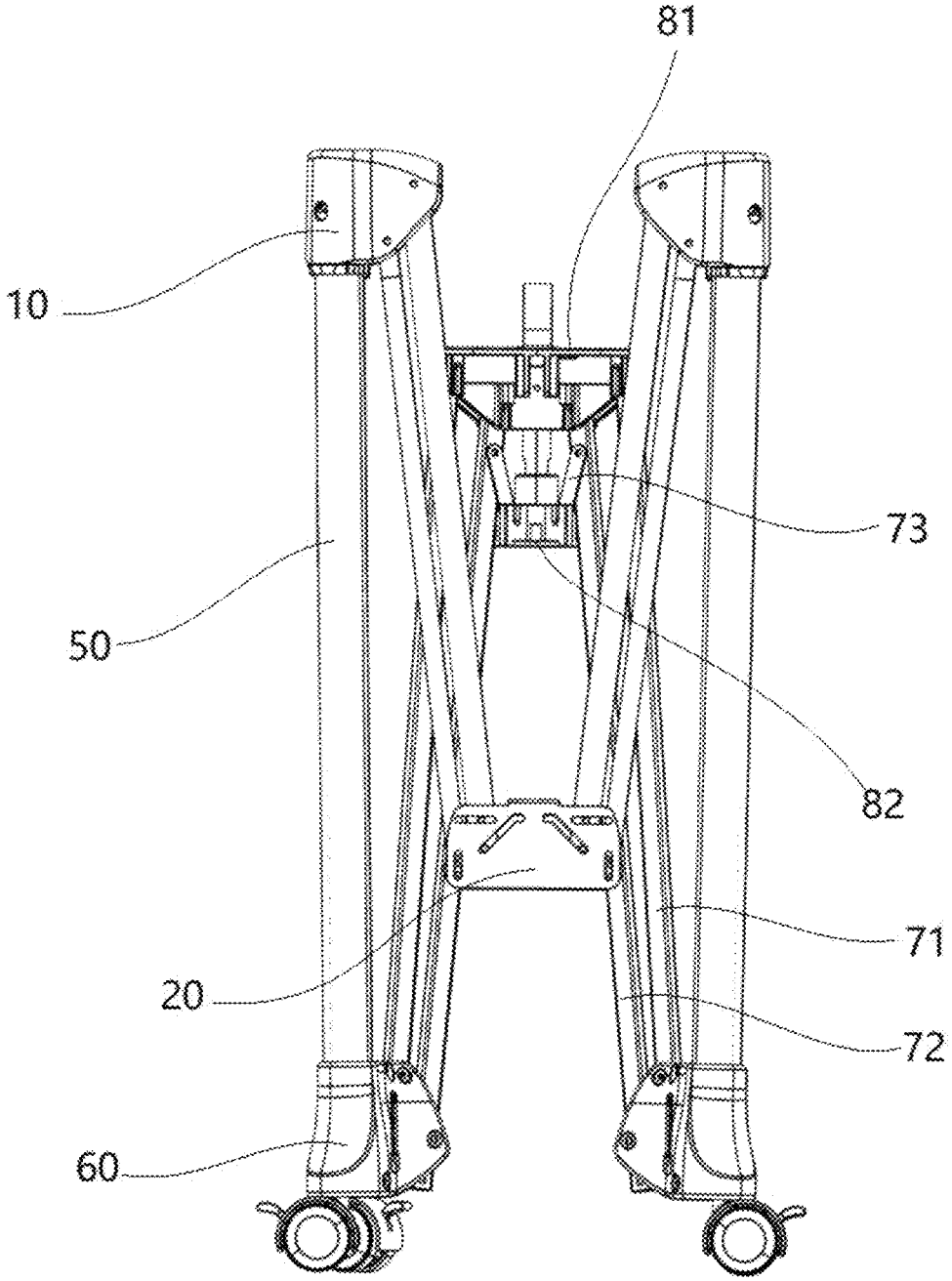
FIG. 4 is a schematic diagram of the folding bed structure shown by FIG. 1 in a folded state.
Figure 5:
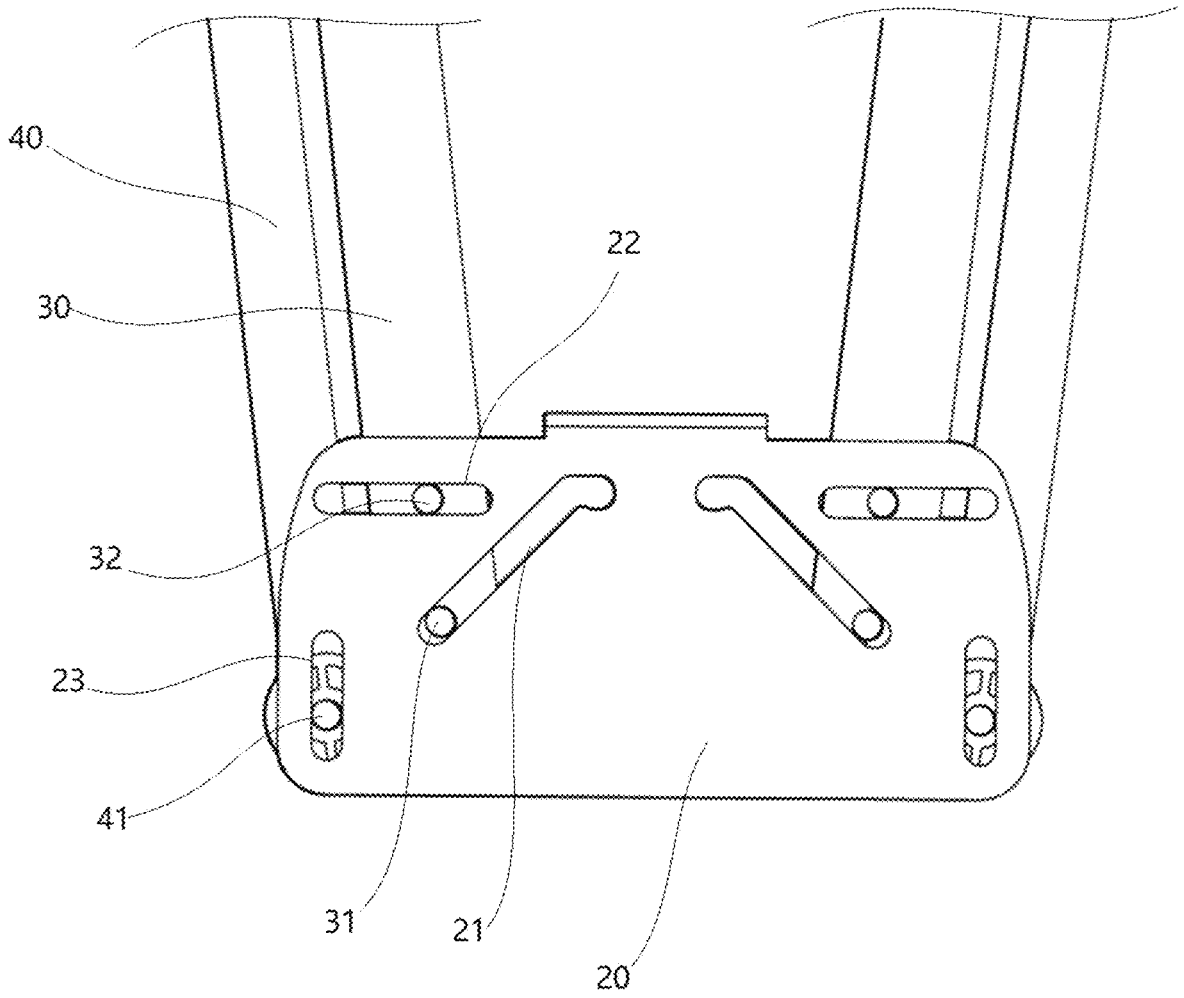
FIG. 5 is an enlarged view of the armrest assembly of FIG. 4.

As shown in FIGS. 1-3, a folding bed structure provided in an embodiment of the present disclosure includes a plurality of mounting sleeves 10, and an armrest assembly is arranged between adjacent mounting sleeves 10. The armrest assembly includes:

the joint connector 20, where the joint connector 20 is symmetrically provided with two first sliding grooves 21 near the upper part of the joint connector 20, and the distance between the two first sliding grooves 21 gradually increases from top to bottom; and the second sliding groove 22 is provided on each of the sides, facing away from each other, of the two first sliding grooves 21;

two upper enclosing rods 30, where the two upper enclosing rods 30 are located on both sides of the joint connector 20 respectively, the first guide pin 31 is provided at each of the ends, adjacent to each other, of the two upper enclosing rods 30, and the first guide pin 31 is embedded in the first sliding groove 21 and can slide along the first sliding groove 21; a rod body part of the upper enclosing rod 30 is slidably connected to the joint connector 20, the second guide pin 32 is arranged on the rod body of the upper enclosing rod 30, and the second guide pin 32 is slidably embedded in the second sliding groove 22; and the ends, away from each other, of the upper enclosing rods 30 are rotatably connected to the mounting sleeves 10;

referring to FIGS. 1-3, when the folding bed structure is unfolded, the first guide pin 31 is positioned on the top of the first sliding groove 21, and the second guide pin 32 is positioned on the end, adjacent to the first sliding groove 21, of the second sliding groove 22; and referring to FIGS. 4-5, when the folding bed structure is folded, the first guide pin 31 slides to the bottom of the first sliding groove 21, and the second guide pin 32 slides towards the end away from the first sliding groove 21;

two lower enclosing rods 40, where the two lower enclosing rods 40 are respectively arranged under one upper enclosing rod 30 side by side; and the ends, away from each other, of the lower enclosing rods 40 are respectively rotatably connected to the mounting sleeves 10, and the ends, adjacent to each other, of the lower enclosing rods 40 are respectively slidably connected to the joint connector 20; and the lower part of each of the mounting sleeves 10 is connected to the support seat 60 through the upright rod 50, and each support seat 60 is hinged to the unlocking base 80 arranged in the middle of the lower part of a bed body through the connection rod group 70.

Specifically, the lower part of each of the mounting sleeves 10 is connected to the support seat 60 through the upright rod 50, and a plurality of support seats 60 are respectively connected to the unlocking base 80 through the connection rod groups 70; when the bed frame is folded, the unlocking base 80 is held with hand and lifted upward, and the plurality of support seats 60 simultaneously approach and retract towards the unlocking base 80; at this time, the lower parts of the four upright rods 50 are pulled and retracted inward; since the length of the lower enclosing rod 40 is always constant, when the lower part of the upright rod 50 is retracted inward, the upper part of the upright rod 50 expands outward, and the upper part of the upright rod 50 pulls the upper enclosing rod 30 to move outward through the mounting sleeve 10. When moving outward, the upper enclosing rod 30 drives the first guide pin 31 to gradually move outward and downward along the first sliding groove 21, and at the same time, the joint connector 20 gradually falls under the whole retraction action of the upright rod 50; and when the unlocking base 80 is lifted to the highest position, the first guide pin 31 slides to the bottom of the first sliding groove 21, the joint connector 20 is lowered to the lowest position, and the entire bed body is folded and retracted.

In this embodiment, the upper enclosing rod 30 is slidably connected to the joint connector 20, and the lower enclosing rod 40 is slidably connected to the joint connector 20, such that each component of the armrest assembly has sufficient movement clearance from unfolding to folding, thereby achieving flexible transformation. Since the bed body transforms easily, it does not take a lot of effort to compress the bed body, and the rods can also be prevented from being broken under great force or being worn out at connected positions.

Referring to FIG. 2, in some embodiments, the second sliding groove 22 extends horizontally. The horizontally extended second sliding groove 22 allows the end, connected to the joint connector 20, of the upper enclosing rod 30 to always move outward in the horizontal direction when folded.

Referring to FIG. 2, in some embodiments, the third sliding grooves 23 extending up and down are symmetrically formed in the lower part of the joint connector 20, and the third guide pin 41 is formed at each of the ends, adjacent to each other, of the two lower enclosing rods 40. The third guide pin 41 is embedded in the third sliding groove 23 and can slide along the third sliding groove 23; and when the folding bed structure is unfolded, the third guide pin 41 is positioned at the bottom of the third sliding groove 23, and when the folding bed structure is folded, the third guide pin 41 slides towards the top of the third sliding groove 23.

During the folding process, the joint connector 20 gradually descends, and the descending of the joint connector 20 also drive the lower enclosing rod 40 to descend. The third sliding groove 23 provides a movement clearance for the lower enclosing rod 40, so that the lower enclosing rod 40 and the joint connector 20 are relatively independent from each other, and the lower enclosing rod 40 does not have to move synchronously with the joint connector 20, thereby ensuring that the joint connector 20 can move freely when folding or unfolding, and the folding or unfolding of the bed body is more flexible and smoother.

Referring to FIG. 2, in some embodiments, the length of the third sliding groove 23 is 3-5 mm. The length 3-5 mm of the third sliding groove 23 is not too small and does not result in insufficient movement clearance, which ensures the freedom of movement of the lower enclosing rod 40 when folded; and the length of the third sliding groove 23 is not too large, does not result in the length waste of movement clearance, and ensures that the joint connector 20 itself has sufficient structural strength.

Referring to FIG. 2, in some embodiments, the included angle between the first sliding groove 21 and the horizontal plane is 45°-60°. The included angle 45°-60° between the first sliding groove 21 and the horizontal plane is not too small, so as to avoid that the distance for the first guide pin 31 to move downward along the first sliding groove 21 is not obvious when folding. The first guide pin 31 moves downward along the first sliding groove 21 for a suitable distance when folding, which can ensure the normal realization of the folding function; and this included angle is not too large, so as to avoid causing the distance for the first guide pin 31 to move downward along the first sliding groove 21 to be too large when folding, which ensures that the folding speed is not too fast.

Referring to FIG. 2, in some embodiments, the length of the first sliding groove 21 is 3-5 mm. The length 3-5 mm of the first sliding groove 21 is not too small, does not result in insufficient movement clearance, and ensures the freedom of movement of the upper enclosing rod 30 when folding; and the length of the first sliding groove 21 is not too large, does not result in the length waste of movement clearance, and ensures that the joint connector 20 itself has sufficient structural strength.

Referring to FIG. 3, in some embodiments, the unlocking base 80 includes the upper unlocking base 81 and the lower unlocking base 82 that are inserted up and down. The connection rod group 70 includes the upper connection rod 71 and a lower connection rod group that are arranged side by side up and down. Both ends of the upper connection rod 71 are respectively hinged to a side of the upper unlocking base 81 and the support seat 60; and the lower connection rod group includes the first lower connection rod 72 and the second lower connection rod 73 that are hinged. The outer end of the first lower connection rod 72 is hinged to the support seat 60, and the inner end of the second lower connection rod 73 is hinged to the lower unlocking base 82.

Referring to FIG. 4, when the bed frame is folded, the upper unlocking base 81 is held with hand and lifted upward, so that the upper unlocking base 81 and the lower unlocking base 82 are separated and simultaneously move upward; and when moving upward, the upper unlocking base 81 and the lower unlocking base 82 simultaneously drive one end of the connected upper connection rod 71 and one end of the lower connection rod group to swing upward. At this time, the other ends of the upper connection rods 71 and the other ends of the lower connection rod groups pull the plurality of support seats 60 simultaneously to approach and gather towards the unlocking base 80. At this time, the support seats 60 at the four corners respectively drive the lower parts of the four upright rods 50 to retract inward and start the folding action.

In this embodiment, the upper unlocking base 81 and the lower unlocking base 82 are plug-in type to realize locking and separating, and the structure is simple; during operation, unlocking can be achieved by lifting the upper unlocking base 81 upward; and the connection rods are hinged to each other, which facilitates linkage and realizes flexible unfolding and folding.

It can be understood that the size of all figures in this case does not represent the actual scale and are only schematic diagrams.

The technical features of the above-described embodiments can be combined in any way. For the sake of brevity of description, not all possible combinations of the technical features in the above-described embodiments have been described. However, as long as there is no contradiction between the combinations of these technical features, they should be considered to be within the scope of this specification.

The above-described embodiments only express several embodiments of the present disclosure, and their descriptions are specific and detailed, but they cannot be understood as limitations on the scope of the patent application. It should be pointed out that for those skilled in the art, several modifications and improvements can be made without departing from the ideas of the present disclosure, which all fall within the scope of protection of the present disclosure. Therefore, the scope of protection of the present disclosure shall be subject to the attached claims.

What is claimed is:

1. A folding bed structure, comprising a plurality of mounting sleeves, and an armrest assembly arranged between adjacent mounting sleeves, wherein the armrest assembly comprises:

a joint connector, wherein the joint connector is symmetrically provided with two first sliding grooves near an upper part of the joint connector, and a distance between the two first sliding grooves gradually increases from top to bottom; and a second sliding groove is provided on each of sides, facing away from each other, of the two first sliding grooves;

two upper enclosing rods, wherein the two upper enclosing rods are located on both sides of the joint connector respectively, a first guide pin is provided at each of ends, adjacent to each other, of the two upper enclosing rods, and the first guide pin is embedded in the first sliding groove and is allowed to slide along the first sliding groove; a rod body part of the upper enclosing rod is slidably connected to the joint connector, a second guide pin is arranged on a rod body of the upper enclosing rod, and the second guide pin is slidably embedded in the second sliding groove;

when the folding bed structure is unfolded, the first guide pin is positioned on a top of the first sliding groove, and the second guide pin is positioned on an end, adjacent to the first sliding groove, of the second sliding groove; and when the folding bed structure is folded, the first guide pin slides to a bottom of the first sliding groove, and the second guide pin slides towards an end away from the first sliding groove;

two lower enclosing rods, wherein the two lower enclosing rods are respectively arranged under one upper enclosing rod side by side; and ends, away from each other, of the two lower enclosing rods are respectively rotatably connected to the mounting sleeves, and ends, adjacent to each other, of the two lower enclosing rods respectively carry a third guide pin that is embedded in and slides along a respective third sliding groove formed in a lower part of the joint connector, third sliding grooves extending up and down symmetrically; and when the folding bed structure is unfolded, each third guide pin is positioned at a bottom of a corresponding third sliding groove, and when the folding bed structure is folded, each third guide pin slides towards a top of the corresponding third sliding groove; and a lower part of each of the plurality of mounting sleeves is connected to a support seat through an upright rod, and each support seat is hinged to an unlocking base arranged in a middle of a lower part of a bed body through a connection rod group, wherein the unlocking base comprises an upper unlocking base and a lower unlocking base that are inserted up and down; the connection rod group comprises an upper connection rod and a lower connection rod group that are arranged side by side up and down; both ends of the upper connection rod are respectively hinged to a side of the upper unlocking base and the support seat; and the lower connection rod group comprises a first lower connection rod and a second lower connection rod that are hinged; and an outer end of the first lower connection rod is hinged to the support seat, and an inner end of the second lower connection rod is hinged to the lower unlocking base; wherein, when the bed frame is folded, the upper unlocking base is configured to be held and lifted upward so that the upper unlocking base and the lower unlocking base are separated and simultaneously move upward, thereby simultaneously driving one end of the connected upper connection rod and one end of the lower connection rod group to swing upward, and the other ends of the upper connection rod and the lower connection rod group pull the plurality of support seats simultaneously to approach and gather towards the unlocking base, the support seats at four corners respectively driving the lower parts of the upright rods to retract inward to start a folding action; and, as the lower part of each upright rod retracts inward while a length of the lower enclosing rod remains constant, an upper part of each upright rod expands outward and pulls the upper enclosing rod to move outward through the mounting sleeve, whereby the upper enclosing rod drives the first guide pin to gradually move outward and downward along the first sliding groove and the joint connector gradually falls; and when the upper unlocking base is lifted to a highest position, the first guide pin is at the bottom of the first sliding groove and the joint connector is lowered to a lowest position.

2. The folding bed structure according to claim 1, wherein a length of the third sliding groove is 3-5 mm.

3. The folding bed structure according to claim 1, wherein an included angle between the first sliding groove and a horizontal plane is 45°-60°.

4. The folding bed structure according to claim 1, wherein a length of the first sliding groove is 3-5 mm.

5. The folding bed structure according to claim 1, wherein the second sliding groove extends horizontally.

* * * * *